US005735229A

United States Patent [19]

House et al.

[11] Patent Number: 5,735,229

[45] Date of Patent: Apr. 7, 1998

[54] PERSONAL WATERCRAFT SEAT HAVING AIR INTAKE SILENCER

[75] Inventors: Ian G. House, Oshkosh; Christopher K. Wachowski, Hartford, both of Wis.

[73] Assignee: Brunswick Corporation, Lake Forest, Ill.

[21] Appl. No.: 764,741

[22] Filed: Dec. 12, 1996

[51] Int. Cl.[6] ..... B63B 17/00

[52] U.S. Cl. ..... 114/363; 181/229; 297/217.1; 440/88

[58] Field of Search ..... 440/88; 114/211, 114/363; 297/180.1, 217.1; 181/214, 229

[56] References Cited

U.S. PATENT DOCUMENTS

| | | | |
|---|---|---|---|
| 4,093,039 | 6/1978 | Moore et al. | 181/229 |
| 4,568,293 | 2/1986 | Yazaki | 440/88 |
| 4,773,883 | 9/1988 | Nakase et al. | 440/88 |
| 4,982,682 | 1/1991 | Hattori | 114/363 |
| 4,984,528 | 1/1991 | Kobayashi | 114/270 |
| 4,996,937 | 3/1991 | Niina et al. | 114/211 |
| 5,014,816 | 5/1991 | Dear et al. | 181/229 |
| 5,125,474 | 6/1992 | Lee et al. | 181/229 |
| 5,340,344 | 8/1994 | Mineo et al. | 440/88 |
| 5,353,734 | 10/1994 | Tani | 114/363 |

*Primary Examiner*—Sherman Basinger
*Attorney, Agent, or Firm*—Andrus, Sceales, Starke & Sawall

[57] ABSTRACT

A personal watercraft has an air intake silencer integral with the seat base. Ambient air is drawn into the seat base and exits the seat base into an engine compartment intake tube which delivers the intake air to an engine compartment. The level of engine noise propagating through the air intake path to the ambient environment is reduced by the acoustic silencer within the seat base. The seat base preferably comprises one or more expansion chambers in series, although other types of silencers such as quarter wavelength resonators and Helmholtz resonators are possible. Additional high frequency sound can be attenuated by placing acoustically absorptive material in the seat base, or by allowing the seat cushion to be exposed to the sound. In the preferred design, an air intake port into the seat base and an air supply port from the seat base to the engine compartment are located towards the aft of the watercraft, and rearward of the acoustic silencer. Because the acoustic silencer extends substantially forward of the air intake port, it is extremely unlikely that water will intrude through the seat base into the engine compartment even if the air intake port is submerged.

36 Claims, 6 Drawing Sheets

FIG. 1
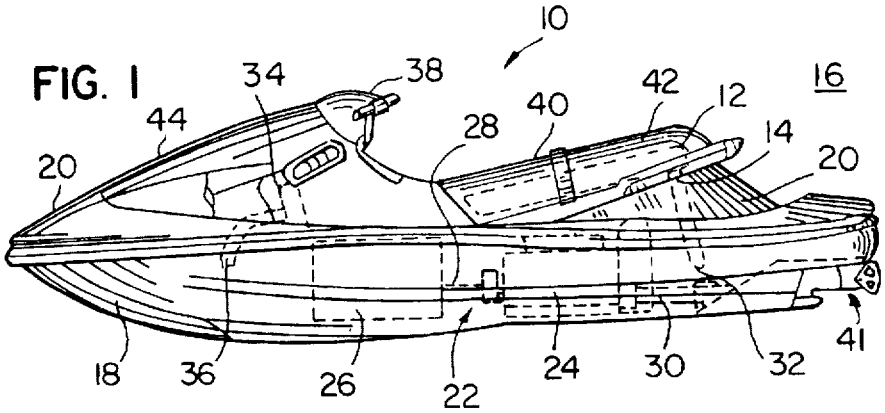
FIG. 2
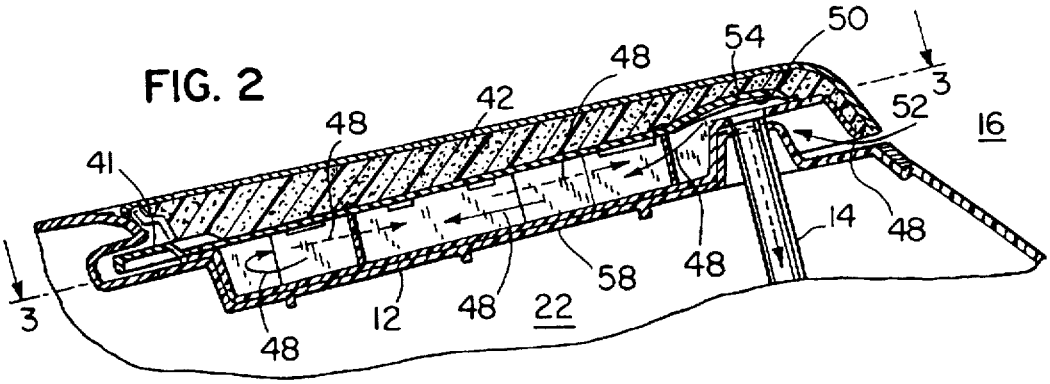
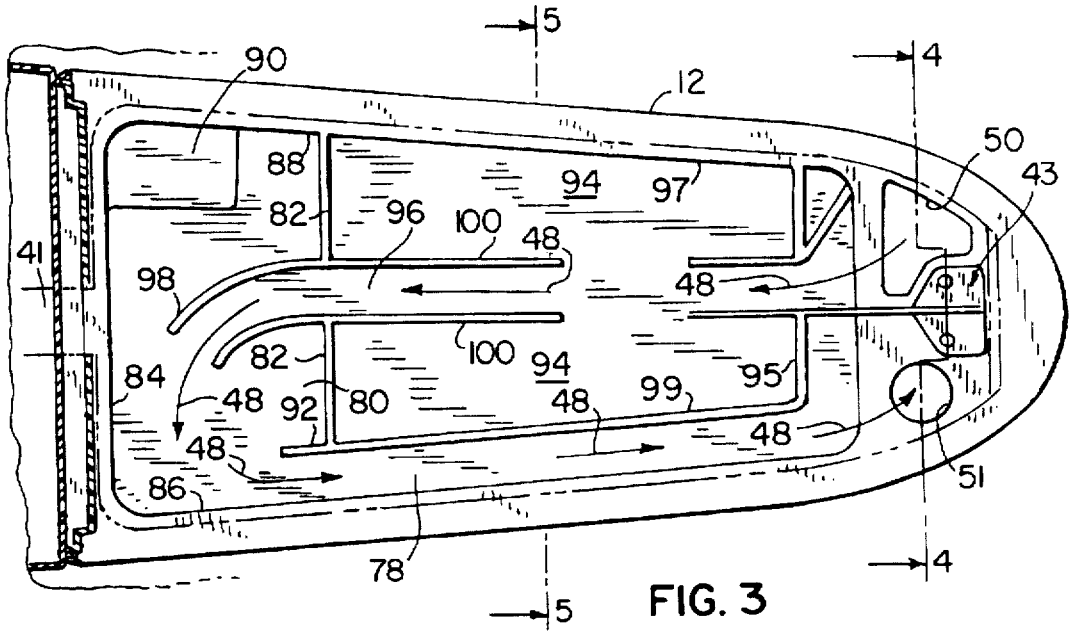
FIG. 3

FIG. 4
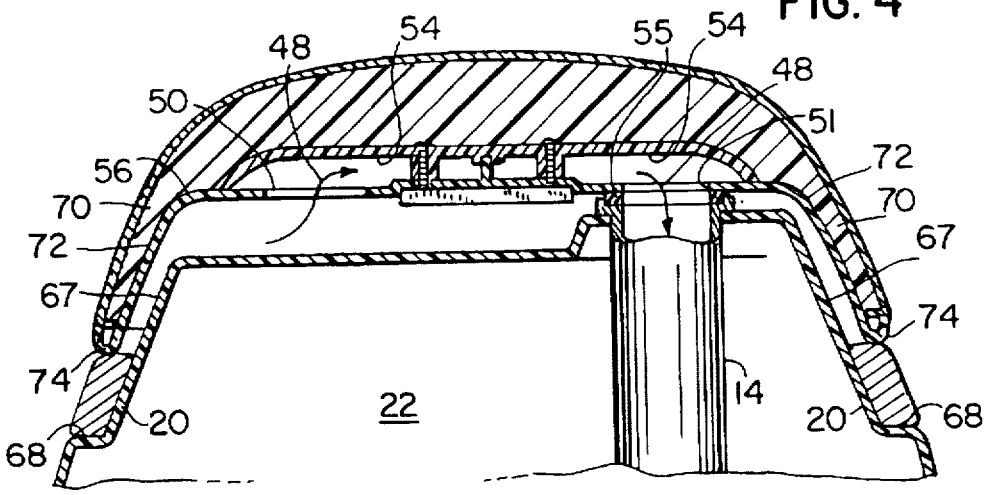
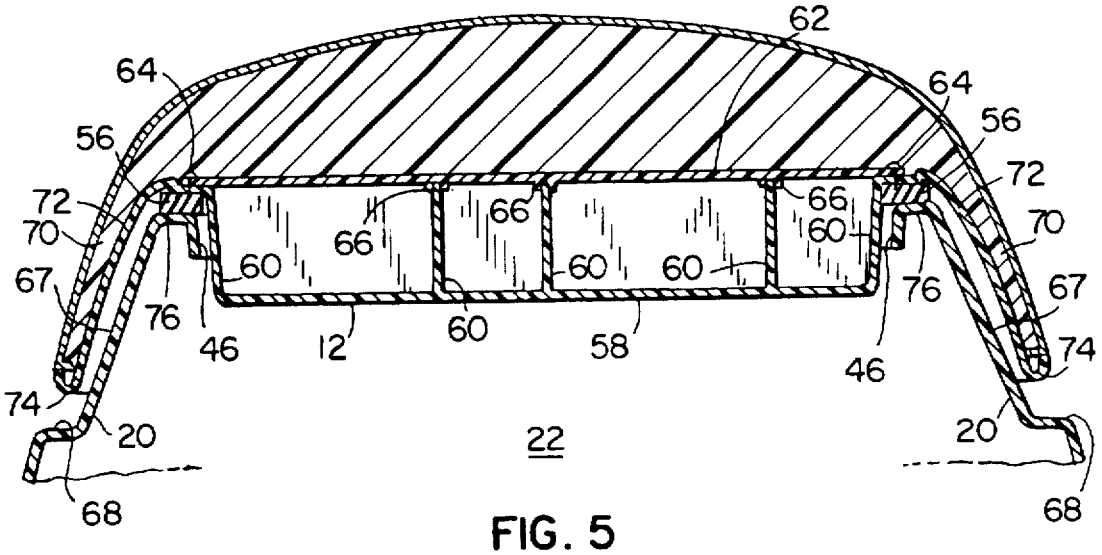
FIG. 5

BEST AVAILABLE COPY

PERSONAL WATERCRAFT SEAT HAVING AIR INTAKE SILENCER

FIELD OF THE INVENTION

The invention relates to an air intake system for a personal watercraft. More specifically, the invention relates to the use of the watercraft seat base as an acoustic silencer for the air intake system.

BACKGROUND OF THE INVENTION

Jet powered personal watercraft typically use an internal combustion engine to drive a jet pump which propels the watercraft. The watercraft normally has a molded fiberglass reinforced hull and deck. The engine is located within an engine compartment between the hull and the deck. It is necessary for the operation of the engine to allow air to flow into the engine compartment from the ambient environment. It is also necessary to vent the engine compartment so flammable gases do not accumulate within the compartment.

A considerable amount of engine noise can propagate from the engine compartment to the ambient environment through the air intake path unless measures are taken to reduce the level of sound propagation. Therefore, personal watercraft usually include some form of silencer for the air intake path. Prior art personal watercraft have used an air induction silencer located within the engine compartment to reduce the level of engine noise propagating through the air intake into the environment. In a personal watercraft, however, it is desirable to conserve space within the engine compartment so there is significant storage capacity as well as sufficient room for the engine, the drive, and other components. It can therefore be appreciated that it is not especially desirable to have a large air induction silencer located within the engine compartment.

The air intake port through the body of the watercraft is usually coupled to a dedicated silencer which is attached to the body. Thus, there is usually a separate component having the purpose of reducing engine noise propagating through the air intake port and minimizing the amount of water that can enter the engine compartment. This can add considerably to the cost of manufacturing a personal watercraft because such air induction silencers must have a reasonably large volume if low frequency attenuation is to be achieved.

In some personal watercraft, intake air is drawn through the seat. In these personal watercraft, air inlets to the seat are located towards the forward portion of the seat and the air supply port to the engine compartment is located towards the aft of the seat. This type of configuration has the advantage of minimizing the amount of water that can enter the engine compartment through the air intake system, but no attempt has been made in these prior art systems to reduce the amount of engine noise propagating through the air intake port in the seat base to the ambient environment.

SUMMARY OF THE INVENTION

In a personal watercraft, it is necessary to provide a seat base (usually a rigid seat base) for the seat assembly. The invention incorporates an air intake silencer into the seat base of the personal watercraft. The invention conserves space within the engine compartment by using the seat base as an acoustic silencer.

An object of the invention is to effectively use the hollow volume in the seat base of a personal watercraft for acoustic silencing. Another object of the invention is to reduce the level of engine sound propagating from the air intake port in a personal watercraft in a cost effective manner. Routing intake air through the seat base and shaping the seat base interior in an acoustically appropriate manner to reduce the level of sound propagating through the air intake path achieves both of these objects. Thus, sound reduction can be accomplished with no additional components, and because of the large volume of the seat base, noise reduction is effective even at relatively low frequencies. In addition, the invention increases the interior volume available for other components of the personal watercraft.

The seat base is mounted to the personal watercraft typically above the engine compartment. The seat base includes an acoustic silencer, an air intake port that allows intake air from the ambient environment to flow into the acoustic silencer, and an air supply port that allows the intake air to flow from the acoustic silencer to an air intake tube into the engine compartment. Alternatively, it may be desirable to route the air intake tube directly to the engine. Intake air flows through the acoustic silencer from the air intake port to the air supply port. Sound, on the other hand, would propagate in the reverse direction. The acoustic silencer in the seat base reduces the level of sound propagating from the engine compartment through the seat base to the ambient environment.

Another object of the invention is to provide an integral silencer within the seat base, yet maintain the structural integrity of the seat base. The preferred seat base is made of rigid molded plastic, and achieves this object. Preferably, the seat base has a substantially flat bottom wall, although regions of the bottom wall may be elevated to provide clearance for components within the engine compartment. The seat base also preferably includes a seat cover plate spaced above and substantially parallel to the bottom wall. A plurality of chamber walls, bounded on the bottom by the bottom wall and the top by the seat cover plate, define the configuration of the acoustic silencer in the seat base.

It is convenient when designing the watercraft that both the air intake port and the air supply port for the seat base be located rearward of the acoustic silencer. The interface between the air supply port in the seat base and the air intake tube into the engine compartment (or alternatively directly connected to the engine) should be sealed to prevent water entry. By locating the acoustic silencer longitudinally forward of the air intake port and the air supply port, it is extremely unlikely that water will be able to intrude through the seat base air intake port eventually into the sealed engine compartment, even if the seat base air intake port were submerged.

The preferred acoustic silencer includes a series of two expansion chambers each having air flow tubes extending therein for tuning purposes. It is preferred that the expansion chambers be sized differently so that one of the chambers is able to attenuate sound at a lower frequency than the other expansion chamber, thereby providing satisfactory noise attenuation over a greater range of frequencies.

Other types of acoustic silencers besides expansion chambers can be used in carrying out the invention. For instance, a plurality of quarter wavelength resonators, or a plurality of Helmholtz resonators can be used effectively.

Expansion chambers, quarter wavelength resonators, a Helmholtz resonators operate effectively at low frequen These types of silencers are therefore well suited for r ing the level of noise exiting the personal watercra r intake, which is mainly dominated by sound frequen in the hundreds of Hz range. If it is desirable to rove attenuation of high frequency noise, acoustically absorptive material may be placed within the silencer (for example, placing foam within an expansion chamber), although this may reduce the performance of the silencer at lower frequencies. Alternatively, it may be desirable to place holes or perforations in the top of the seat base to acoustically expose the sound propagating through the silencer to a foam seat cushion to absorb high frequency sound.

Other features and advantages of the invention should be apparent to those skilled in the art upon review the drawings and the following description thereof.

BRIEF DESCRIPTION OF THE DRAWINGS

FIG. 1 is a side view of a personal watercraft in accordance with the invention having an acoustic silencer in the seat base to reduce the level of sound propagating through an air intake passage to the ambient environment.

FIG. 2 is a vertical section view illustrating the flow of intake air through the acoustic silencer.

FIG. 3 is a view taken along line 3—3 in FIG. 2 showing a first embodiment of the invention using expansion chambers.

FIG. 4 is a vertical section view taken along line 4—4 shown in FIG. 3.

FIG. 5 is a vertical section view taken along line 5—5 shown in FIG. 3.

DETAILED DESCRIPTION OF THE DRAWINGS

Figure 6:
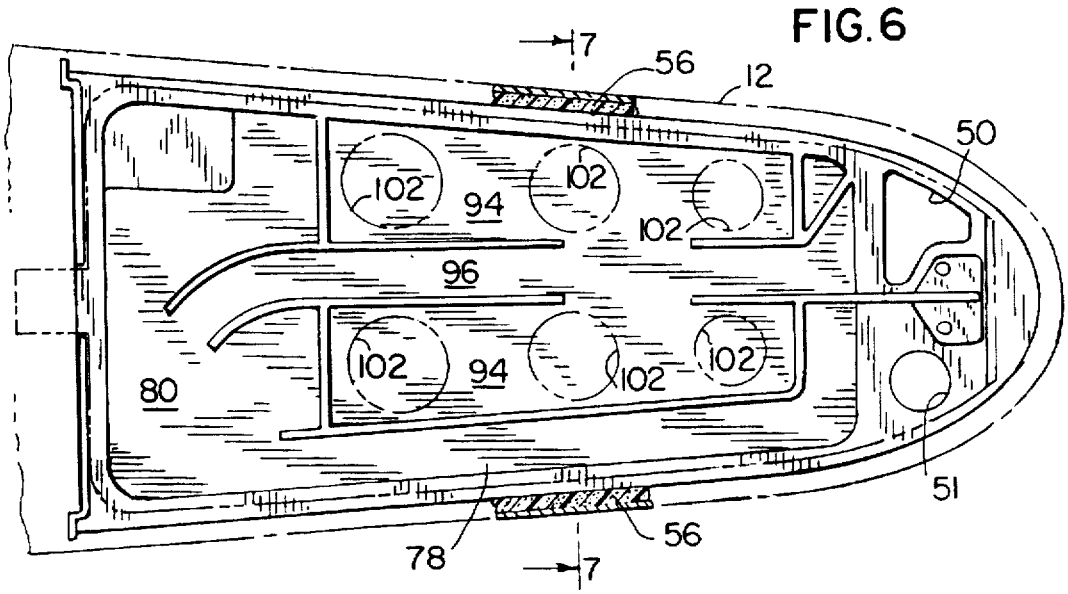
FIG. 6 is a view similar to FIG. 3 showing holes placed in the seat base cover plate.

FIG. 1 illustrates a personal watercraft 10 having a seat base 12 having an integral acoustic silencer to reduce the level of sound propagating from the watercraft 10 through an air intake passage 14 to the ambient environment 16.

The watercraft 10 has a hull 18 and a deck 20, both preferably made of molded fiberglass reinforced resin. An engine compartment 22 is located within a space between the hull 18 and the deck 20. An internal combustion engine 24 is located within the engine compartment 22. Although not shown in the drawings, an induction silencer or an air fox is preferably attached to the engine 24. A fuel tank 26 is located forward of the engine 24 within the engine compartment 22. The fuel tank 26 provides fuel to the engine 24 through fuel line 28. The engine 24 has an output shaft 30 that is coupled to a jet pump rearward of the engine 24.

Induction air for the engine 24 flows from the ambient environment 16 into the seat base 12. The induction air flows from the seat base 12 through air intake tube 14 into the engine compartment 22. (Alternatively, it may be desirable to connect the air intake tube 14 directly to the engine 24.) The engine compartment air intake tube 14 has an outlet port 32 that is located towards the rear of the watercraft 10 and close to the bottom of the hull 18. A vent 34 is provided forward of the engine 24, and provides an air flow path through the deck 20. The vent 34 has an inlet port 36 that is located at a height above the outlet port 32 for the air intake tube 14. The purpose of the vent 34 is to allow air and possibly accumulated flammable gases to escape from the engine compartment 22.

A handlebar assembly 38 is provided forward of a seat assembly 40. The handlebar assembly 38 provides a means for the driver of the watercraft to steer the watercraft 10 by moving the orientation of a jet nozzle 41. The seat assembly 40 is generally longitudinal, and configured so that a driver and/or passenger on the watercraft 10 straddles the seat assembly 40 while riding the watercraft 10. The seat assembly 40 includes a seat base 12, and a seat cushion 42.

The engine compartment 22 is accessible forward of the handlebar steering assembly 38 by opening hood 44. It is preferred that a storage compartment be removably placed under the hood 44. The engine compartment 22 is accessible rearward of the handlebar steering assembly 38 by lifting the seat assembly 40. The deck 20 is configured to have a hole 46, FIG. 5, sized to receive the seat base 12 and provide access to the engine compartment 22 when the seat assembly 40 is lifted. The seat assembly 40 can be completely removed from the watercraft 10. A tongue 41 (FIGS. 2 and 3) is provided at the far end of the seat base 12 to anchor the front of the seat base 12 to the watercraft 10. A latch in the vicinity of arrow 43 is provided to secure the aft of the seat assembly 40 to the watercraft 10.

A first embodiment of the invention is depicted in detail in FIGS. 2–5. In FIGS. 2–5, ambient air 16 flows through the seat base 12 and through the engine compartment air intake tube 14 into the engine compartment 22. In accordance with the invention, the seat base 12 is configured to be an acoustic silencer. The arrows in FIGS. 2 and 3 denoted by reference number 48 illustrate the direction of intake air flow through the seat base 12 into the engine compartment air intake tube 14 and eventually into the engine compartment 22. Ambient air flows into the seat base 12 through an air intake port 50, FIGS. 3 and 4. Air intake port 50 is sheltered from splashing water by the overhanging portion 52 of the seat (FIG. 2) and portion 70 (FIG. 4). The top wall 54 of the seat base 12 is raised in the area of the air intake port 50 to provide an adequate air flow path for the intake air. Air flows from the seat base 12 into the engine compartment 22 through air supply port 51. The top wall 54 of the seat base 12 is also raised in the area of the air supply port 51 to provide an adequate air flow path. A seal 55 is provided on the top end of the engine compartment air intake tube 14 to sealingly engage the air supply port 51 to the engine compartment air intake tube 14 when the seat is closed.

A foam gasket 56, FIGS. 4 and 5, is attached to a bottom surface of the seat base 12 to seal the engine compartment 22 when the seat assembly 40 is latched closed. It should be appreciated that due to the configuration of the air intake path through the seat base 12, it is extremely unlikely that water would intrude into the engine compartment 22 through the seat base 12, even if the air intake port 50 in the seat base were submerged.

Referring in particular to FIG. 5, the seat base 12 has a substantially flat bottom wall 58. A plurality of vertical chamber walls 60 extend upward from the bottom wall 58 about 2 inches. A seat cover plate 62 is spaced above and substantially parallel to the bottom wall 58 and is fastened

BEST AVAILABLE COPY to the seat base 12 to cover channels and chambers defined by the chamber walls 60. The seat cover plate 62 is preferably a separate component of the seat base 12, and removably attached to the seat base 12. The seat cover plate 62 is fastened to the seat base 12 using fasteners such as fasteners 64, FIG. 5. The channels and chambers in the seat base 12 should be acoustically sealed from one another at the interface between the chamber walls 60 and the seat cover plate 62. The preferred way of acoustically sealing these interfaces is to provide a plurality of continuous downwardly extending grooves 66 in the seat cover 62 which are adapted to receive the top end of the chamber walls 60. The grooves 66 also maintain the structural stability of the seat base 12 by keeping the chamber walls 60 upright when a load is on the seat assembly 40.

The deck 20 slants inward as it extends upward towards the engine compartment hole 46, as shown by reference numeral 67. The upwardly slanting portion of the deck 20 has an inward step 68. The inward step 68 provides a region for a peripheral overhang portion 70 for the seat assembly 40 to reside. The overhang portion 70 comprises a portion 72 of the seat base 12 extending downward and slightly outward from the top of the outermost chamber wall 60, and also a layer of seat cushion covering the seat base portion 72. The bottom 74 of the seat base portions 72 is curved upward. As the deck 20 extends upward from the step 68, the deck angles inward corresponding to the overhang portion 72 of the seat base 12 to a location where the deck 20 turns inward to provide a platform 76 for the foam gasket 56 to seal against the deck 20. The foam gasket 56 extends around the seat base 12 bottom at a location corresponding to the engine compartment hole 46 in the deck 20. The foam gasket 56 thus traverses the seat base 12 at a location forward of the air intake port 50 and the air supply port 51. In the rear portion of the seat assembly 40, the peripheral overhang portion 70 extends rearward of the air intake port 50 and the air supply port 51, see reference numeral 52 in FIG. 2.

Referring to FIGS. 2 and 3, sound propagating from the engine compartment 22 to the ambient environment 16 through the seat base 12 would propagate in the direction generally opposite of the air intake flow (shown by arrows 48) in the absence of attenuation or reflection. In particular, sound propagates from the engine compartment 22 through the air intake tube 14 into the seat base 12, and upon entering the seat base 12, the sound propagates from the air supply port 51 through a channel 78 to a first expansion chamber 80. The width of the first expansion chamber 80 from wall 82 to wall 84 is about 8 inches. The length of the first expansion chamber 80 from wall 86 to wall 88 is about 14 inches. The depth of the first expansion chamber is about 2 inches, except in the region designated by reference numeral 90 in which the bottom wall 58 of the seat base 12 is elevated to provide clearance for components in the engine compartment 22. Note that chamber wall 92 extends into the first expansion chamber 80, thus extending channel 78 into the first expansion chamber 80. The wall 92 extends about 1½ inches beyond the wall 82. Although the specific dimensions of the expansion chamber 80 and the length of wall portion 92 for the channel 78 are not necessarily critical, it is preferred that the size of the expansion chamber 80 and the length that channel 78 and channel 96 extend into the expansion chamber 80 be sized to provide generally uniform sound attenuation over a desired frequency band.

Sound propagates from the first expansion chamber 80 into a second expansion chamber 94 through channel 96. A forward end 98 of the channel 96 is curved towards channel 78 to assist air flowing through the seat base 12.

The second expansion chamber 94 is larger than the first expansion chamber 80. In the exemplary embodiment of the invention, as shown in FIGS. 2 and 3, the length of the second expansion chamber 94 is about 16 inches (e.g., the distance between walls 82 and 95). The width of the second expansion chamber 94 is preferably in the range of 8 inches to 11 inches (i.e., the preferred distance between walls 97 and 99). Walls 100 define the channel 96 forward of wall 82, and extend 8 inches beyond wall 82. The specific size of the second expansion chamber 94 and the length of walls 100 into the second expansion chamber 94 are not critical, but it is preferred that they be chosen so that there is relatively uniform sound attenuation over a chosen frequency band. It is preferred that the length of the second expansion chamber 94 (i.e. the distance between walls 82 and 95) be different than the length of the first expansion chamber 80 (i.e. the distance between walls 86 and 88) so that the second expansion chamber 94 will be able to effectively attenuate sound at a lower frequency than the first expansion chamber 80. In this manner, the two expansion chambers 80 and 94 placed in series operate to effectively attenuate over a wider range of frequencies than simply two chambers having the same dimensions.

Sound is either absorbed in the expansion chambers 80 and 94, or reflected back into the engine compartment 22. The remaining absorbed and unreflected sound exits through the air intake port 50 to the ambient environment 16.

The embodiment of the invention shown in FIG. 3 is well suited to attenuate sound over a broad range of frequencies. The system as shown in FIG. 3 attenuates high frequency sound to some extent, but there may be some higher frequencies for which improved attenuation is desirable. If it is desirable to attenuate higher frequency sound, the embodiments shown in FIGS. 6 and 7, or FIGS. 8 and 9 can be used. In the embodiment of the invention shown in FIGS. 6 and 7, the seat cover plate 62 has holes 102 placed therein. In this manner, high frequency sound in the second expansion chamber 94 can escape through the holes 102 in the seat cover plate 62, and be absorbed into the seat cushion 42. The seat cushion 42 should be made of acoustically absorptive material, such as an open-cell foam that is preferably sealed within a waterproof and acoustically transmissive membrane to prevent water from saturating the cushion 42. Alternatively, a closed-cell foam may be used, although sound absorption capability may be less.

Holes 102 may also be placed in the seat cover plate 62, in the first expansion chamber 80, and/or channels 96 and 78. In addition, the size and number of holes 102 can vary.

Figure 7:
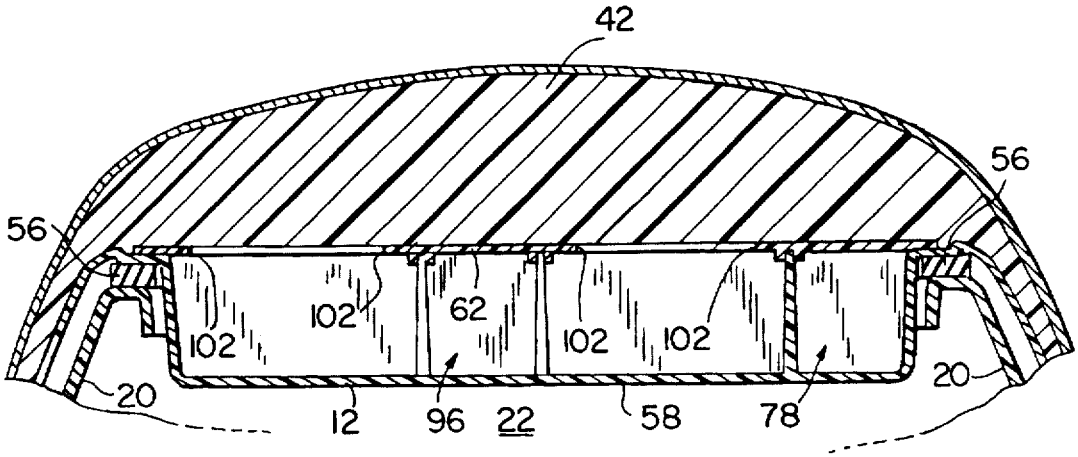
FIG. 7 is a sectional view taken along line 7—7 in FIG. 6.
Figure 8:
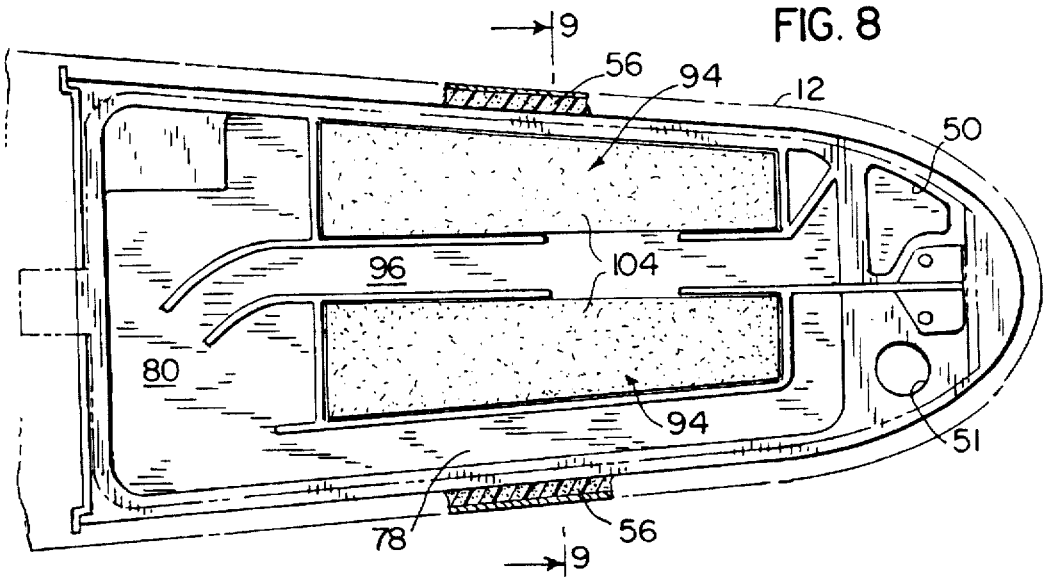
FIG. 8 is another view similar to FIG. 3 showing acoustically absorptive material placed within an expansion chamber of the acoustic silencer.
Figure 9:
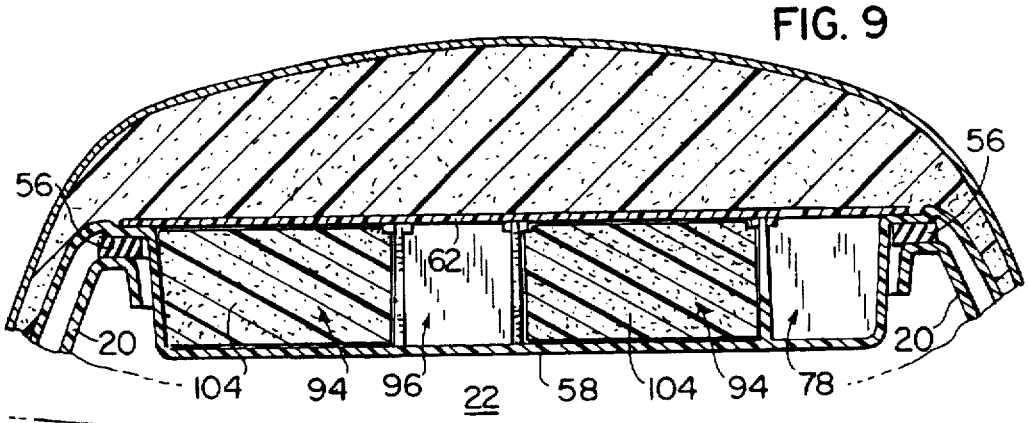
FIG. 9 is a sectional view taken along line 9—9 in FIG. 8.

FIGS. 8 and 9 show another embodiment of the invention useful for attenuating high frequency sound in which pieces 104 of acoustically absorptive material are placed in the second expansion chamber 94. The pieces 104 of acoustically absorptive material should not interfere with air flow through the seat base 12. It may be preferable to place pieces 104 of acoustically absorptive material in the expansion chamber 94, rather than providing holes 102 in the seat cover plate 62 as shown in FIGS. 6 and 7, to prevent the seat cushion 42 from absorbing water. On the other hand, placing the pieces 104 of acoustically absorptive material in the expansion chamber 94 can reduce the performance of the expansion chamber 94 at low frequencies. It may also be desirable to place acoustically absorptive material in the first expansion chamber 80. If so, an air path should be provided through the expansion chamber 80.

Figure 11:
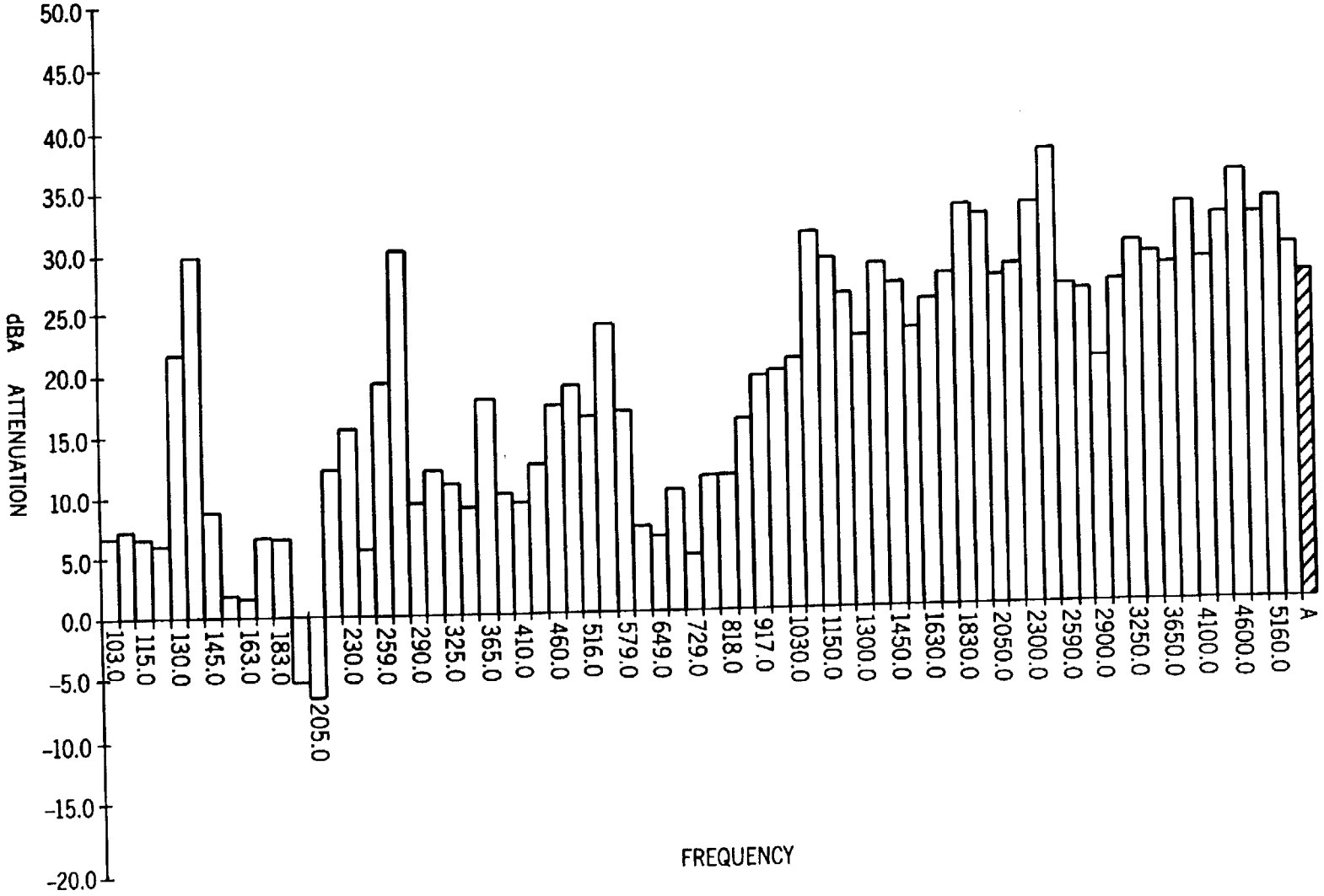
FIG. 11 is a graph illustrating the performance of the acoustic silencer shown in FIG. 3.

FIG. 11 is a graph illustrating the performance of the acoustic silencer described in FIGS. 2–5. In FIG. 11 [illegible]nuation in decibels which are A-frequency weighted (dBA) are plotted versus the frequency of engine noise. The silencer in FIGS. 2–5 attenuates a substantial amount of low frequency sound (e.g., sound less than about 1,000 Hz). The silencer can achieve such performance at low frequencies mostly because the seat base 12 provides a sufficiently large volume to attenuate low frequency sound. The seat base silencer also attenuates a substantial amount of higher frequency sound.

Figure 10:
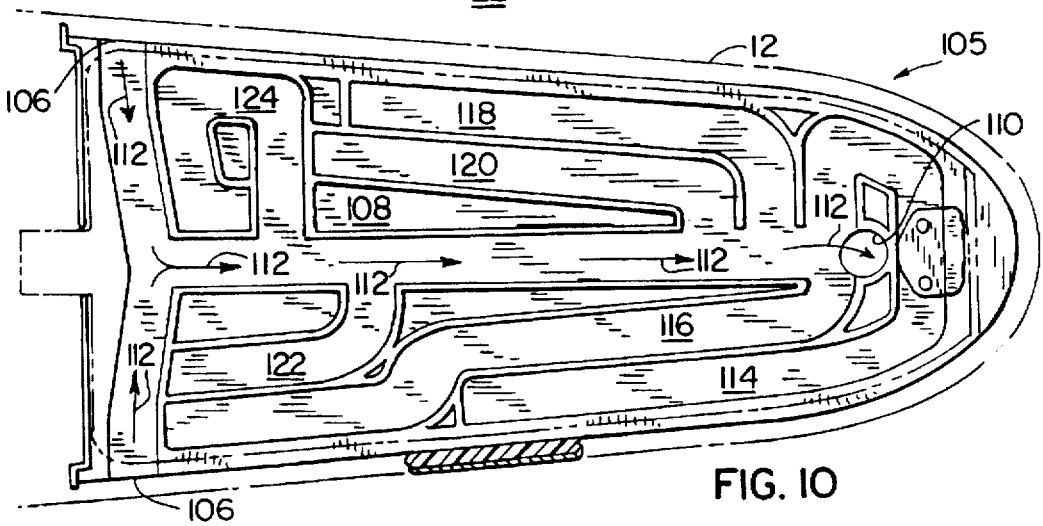
FIG. 10 is a horizontal sectional showing another embodiment of the invention wherein the acoustic silencer includes a plurality of quarter wavelength resonators.

Referring now to FIG. 10, in another embodiment 105 of the invention, the seat base 12 includes a plurality of quarter wavelength resonators 114, 116, 118, 120, 122, 124. In FIG. 10, intake air enters a front portion of the seat base 12 through an air intake ports 106. The air flows from the air intake ports 106 through a main channel 108, and exits the seat base 12 through an air supply port 110 located at the rear of the seat base 12. The flow of air through the seat base 12 is indicated by arrows 112. On the other hand, sound propagating from the engine compartment 22 through the seat base 12 to the ambient environment 16 would propagate in the direction opposite of arrows 112. In the seat base silencer 105 of FIG. 10, multiple channels 114, 116, 118, 120, 122 and 124 comprise a plurality of multiple quarter wavelength resonators. Rear channel 114 is the longest channel, and front channel 124 is the shortest channel. The length of the channels 116, 118, 120 and 122 continually decreases along the path of acoustic propagation. It is preferred that the width of the quarter wavelength channels 114, 116, 118, 120, 122 and 124 be at least as wide as the main channel 108 because such design provides for maximum attenuation. Although not shown in FIG. 10, holes may also be placed in the seat cover plate 62, in the channels 108, 114, 116, 118, 120, 122 or 124 to attenuate higher frequencies of sound as previously described.

Figure 12:
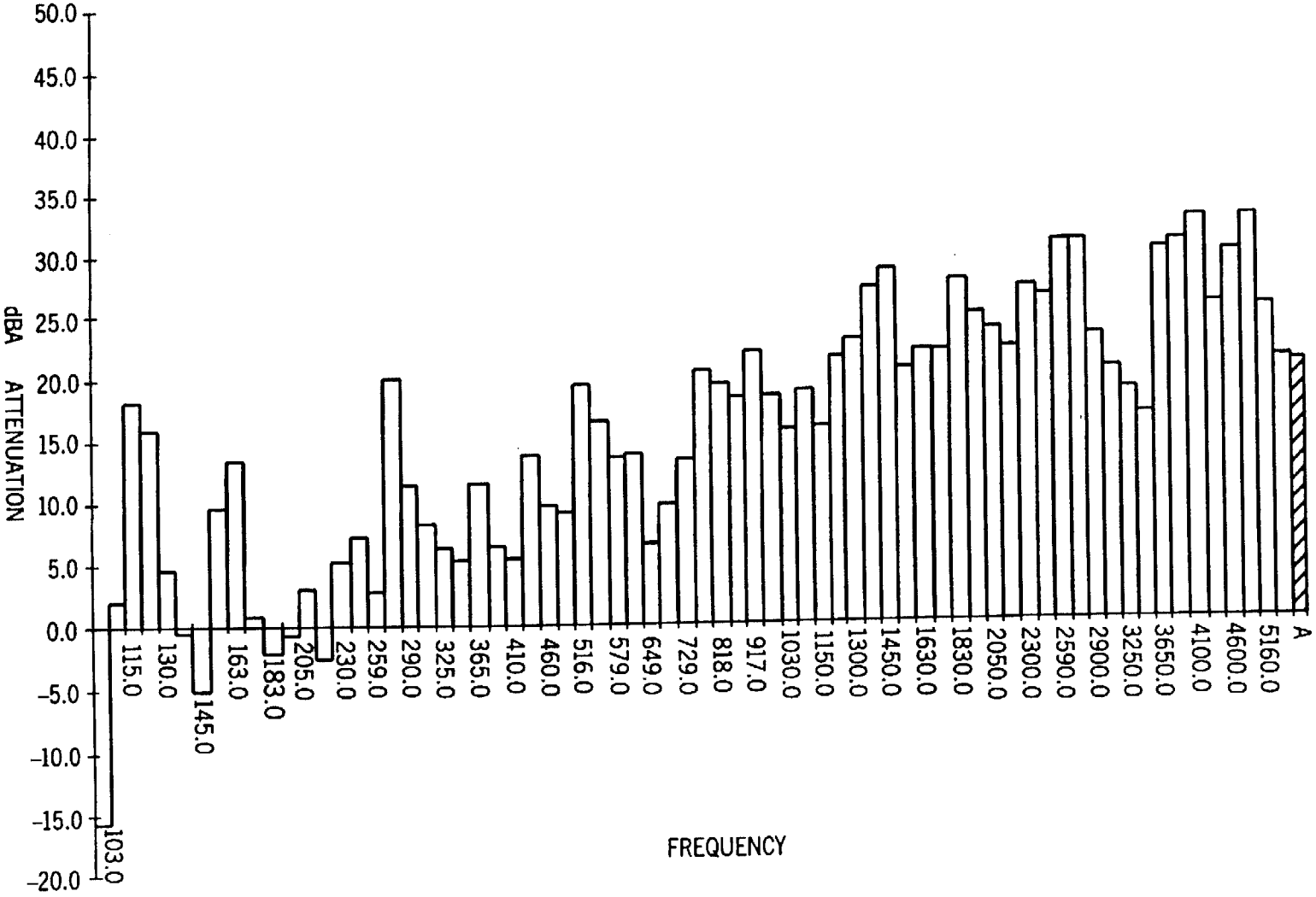
FIG. 12 is a graph illustrating the performance of an acoustic silencer shown in FIG. 10.

FIG. 12 is a graph illustrating the performance of the embodiment 105 of the acoustic silencer shown in FIG. 10. In FIG. 12, attenuation in decibels which are A-frequency weighted (dBA) are plotted versus the frequency of sound being attenuated. The silencer 105 with quarter wavelength resonators prevents a substantial amount of sound from propagating through the air intake port 110. Attenuation at low frequencies (i.e. below about 1,000 Hz) is significant, however, somewhat inconsistent at very low frequencies (i.e. below about 200–250 Hz). The inconsistencies at very low frequencies (i.e. below about 200–250) may be due to testing difficulties. Because the seat base 12 has a significantly large volume, the plurality of quarter wavelength channels 114, 116, 118, 120, 122 and 124 can be sized appropriately and placed within the seat base 12 to obtain significant noise reduction over a broad range of frequencies. If additional noise reduction is desired, it may be possible to provide another quarter wavelength channel that is not wholly integral with the seat base 12 but nonetheless interfaces main channel 108.

Although not shown in the drawings, it should be apparent to one skilled in the art that the seat base could contain a plurality of Helmholtz resonators instead of a series of expansion chambers or a plurality of quarter wavelength resonators.

It should be appreciated that there may be variations and modifications apparent to those skilled in the art which do not depart from the spirit and scope of the invention. For instance, the concept of having an intake silencer incorporated directly into the construction of the seat base may be useful in vehicles other than jet powered watercraft. Such variations or modifications should be considered to be within the scope of the following claims.

We claim:

1. A watercraft comprising:

an engine located within an engine compartment;

an engine compartment air intake tube that allows intake air to flow into the engine compartment from the ambient environment; and a seat located rearward of a steering assembly for the watercraft the seat including a seat base that is mounted to the watercraft, the seat base having an acoustic silencer, an air intake port that allows intake air from the ambient environment to flow into the acoustic silencer, and an air supply port that allows intake air to flow from the acoustic silencer to the engine compartment air intake tube;

wherein the acoustic silencer in the seat base reduces the level of sound propagating from the engine compartment through the engine compartment air intake tube to the ambient environment.

2. The watercraft as recited in claim 1 wherein the acoustic silencer has an expansion chamber.

3. The watercraft as recited in claim 2 wherein the acoustic silencer further has a tube extending into the expansion chamber.

4. The watercraft as recited in claim 2 wherein a piece of acoustically absorptive material is located in the expansion chamber.

5. The watercraft as recited in claim 1 wherein the acoustic silencer has at least two expansion chambers, one of the expansion chambers being able to attenuate sound at a lower frequency than the other expansion chamber.

6. The watercraft as recited in claim 5 wherein both of the expansion chambers have a tube extending therein.

7. The watercraft as recited in claim 1 wherein the seat has a front end and a rear end, and the air intake port and the air supply port are both located at the rear end of the seat rearward of the acoustic silencer.

8. The watercraft as recited in claim 7 wherein the air supply port extends downward from the seat base and is adapted to sealingly engage the air intake tube.

9. A watercraft as recited in claim 1 wherein the seat base comprises:

a substantially flat bottom wall;

a seat cover plate spaced above and substantially parallel to the bottom wall; and a plurality of chamber walls extending between the bottom wall and the seat cover plate;

wherein the bottom wall, the seat cover plate, and the chamber walls define the acoustic silencer in the seat base.

10. A watercraft as recited in claim 9 wherein a piece of acoustically absorptive material is located in the acoustic silencer.

11. The watercraft as recited in claim 9 wherein the seat cover plate includes a plurality of continuous downwardly extending grooves adapted to receive top edges of the respective chamber walls to acoustically seal an interface between the top edges of the chamber walls and the seat cover plate.

12. The watercraft as recited in claim 9 wherein each of the chamber walls has a constant height that is the same for each of the chamber walls.

13. The watercraft as recited in claim 12 wherein the height of the chamber walls is approximately 2 inches.

14. The watercraft as recited in claim 1 wherein the seat base comprises a seat cover plate having a hole therein, and the seat further comprises a seat cushion mounted above the seat base so that a portion of the sound propagating through the seat base can escape through the seat cover plate and be absorbed in the seat cushion.

15. The watercraft as recited in claim 14 wherein the seat cushion is made of closed-cell foam.

16. The watercraft as recited in claim 14 wherein the seat cushion is made of open-cell foam sealed within a waterproof and an acoustically transmissive membrane.

17. The watercraft as recited in claim 1 wherein the acoustic silencer comprises a plurality of quarter wavelength resonators.

18. The watercraft as recited in claim 1 wherein the air intake port is located forward of the acoustic silencer and the air supply port is located rearward of the acoustic silencer.

19. The watercraft as recited in claim 1 wherein the seat base is removably mounted above the engine compartment.

20. The invention as recited in claim 1 wherein the watercraft is a jet powered watercraft.

21. A watercraft as recited in claim 1 wherein the engine compartment is a sealed engine compartment.

22. A seat including a seat base that is adapted to be mounted to a watercraft, the seat base having an air intake port that allows intake air from the ambient environment to flow into the seat base, an air supply port that allows intake air to flow from the seat base to be used as engine intake air, the air intake port and the air supply port being located at the rear end of the seat, and an intake air supply passageway through the seat base which provides an air flow path from the air intake port in the seat base to the air supply port in the seat base, wherein the air supply port is sealed, both the air intake port and the air supply port are located rearward of the air intake passageway through the seat base, and the air intake passageway through the seat base has at least one portion that is closer to the front end of the seat than the rear end of the seat.

23. A seat including a seat base adapted to be mounted in an opening on a watercraft sized to receive the seat base and located above an engine compartment for the watercraft, the seat base containing an acoustic silencer within the seat base; an air intake port that allows intake air from the ambient environment to flow into the acoustic silencer; and an air supply port that allows intake air to flow from the acoustic silencer to be used as engine intake air; wherein ambient air is drawn into the acoustic silencer contained in the seat base through the air intake port for the seat base and exits the acoustic silencer contained in the seat base into the engine compartment through the air supply port for the seat base, and the acoustic silencer in the seat base reduces the level of sound propagating from the engine compartment through the air supply port into the seat base and to the ambient environment through the air intake port from the seat base.

24. The seat recited in claim 23 further including a cushion that is mounted above the seat base.

25. The seat as recited in claim 23 wherein the seat base further comprises:

a substantially flat bottom wall;

a seat cover plate spaced above and substantially parallel to the flat bottom wall; and a plurality of chamber walls extending between the bottom wall and the seat cover plate;

wherein the bottom wall, the seat cover plate, and the chamber walls define the acoustic silencer in the seat base.

26. The seat as recited in claim 25 wherein the seat cover plate includes a plurality of continuously downwardly extending grooves adapted to receive top edges of the respective chamber walls to acoustically seal an interface between the top edges of the chamber walls and the seat cover plate.

27. The seat as recited in claim 25 wherein each of the chamber walls has a constant height that is the same for each of the chamber walls.

28. A watercraft comprising:

an engine located within an engine compartment on the watercraft, the watercraft having an opening above the engine compartment to provide access into the engine compartment;

an engine air intake tube that supplies intake air to the engine; and a seat on the watercraft, the seat having a seat base adapted to be mounted over the opening on the watercraft above the engine compartment, the opening being sized to receive the seat base, the seat base containing an acoustic silencer within the seat base, an air intake port that allows intake air from the ambient environment to flow into the acoustic silencer, and an air supply port that allows intake air to flow from the acoustic silencer to the engine air intake tube;

wherein ambient air is drawn into the acoustic silencer contained in the seat base through the air intake port for the seat base and exits the acoustic silencer contained in the seat base into the engine compartment through the air supply port for the seat base, the acoustic silencer in the seat base reduces the level of sound propagating from the engine through the engine air intake tube to the ambient environment.

29. The watercraft as recited in claim 28 wherein the acoustic silencer has an expansion chamber.

30. The watercraft as recited in claim 29 wherein the acoustic silencer further has a tube extending into the expansion chamber.

31. The watercraft as recited in claim 29 wherein a piece of acoustically absorptive material is located in the expansion chamber.

32. The watercraft as recited in claim 29 wherein the seat base comprises:

a substantially flat bottom wall;

a seat cover plate spaced above and substantially parallel to the bottom wall; and a plurality of chamber walls extending between the bottom wall and the seat cover plate;

wherein the bottom wall, the seat cover plate, and the chamber walls defined the acoustic silencer in the seat base.

33. The watercraft as recited in claim 32 wherein the seat cover plate includes a plurality of continuously downwardly extending grooves adapted to receive top edges of the respective chamber walls to acoustically seal an interface between the top edges of the chamber walls and the seat cover plate.

34. The watercraft as recited in claim 33 wherein each of the chamber walls has a constant height that is the same for each of the chamber walls.

35. The watercraft as recited in claim 29 wherein the acoustic silencer comprises a plurality of quarter wavelength resonators.

36. The watercraft as recited in claim 28 wherein the acoustic silencer has at least two expansion chambers, one of the expansion chambers being able to attenuate sound at a frequency lower than the other expansion chamber.

* * * * *